United States Patent [19]

Nightengale et al.

[11] 4,431,336

[45] Feb. 14, 1984

[54] CONCRETE PREFINISHING TOOL

[76] Inventors: Stanley A. Nightengale, 35297 Weld County Rd. 41, Eaton, Colo. 80615; Harvey P. Burrows, 1633 26th Ave. Ct., Greeley, Colo. 80631

[21] Appl. No.: 346,210

[22] Filed: Feb. 8, 1982

[51] Int. Cl.[3] ..... E01C 19/38

[52] U.S. Cl. ..... 404/97; 404/114; 74/87

[58] Field of Search ..... 404/97, 113, 114, 117, 404/103; 74/87, 61; 173/49

[56] References Cited

U.S. PATENT DOCUMENTS

| | | | |
|---|---|---|---|
| 2,411,317 | 11/1946 | Day | 404/113 |
| 2,514,626 | 7/1950 | Clipson | 404/113 |
| 2,643,595 | 6/1953 | Jackson | 404/113 |
| 2,868,094 | 1/1959 | Andersson | 404/117 |
| 3,376,798 | 4/1968 | Bodine | 404/113 |
| 3,515,042 | 6/1970 | Austin | 404/103 |
| 3,515,043 | 6/1970 | Austin | 404/103 |
| 3,547,014 | 12/1970 | Austin | 404/117 |

*Primary Examiner*—James A. Leppink
*Assistant Examiner*—Beverly E. Hjorth
*Attorney, Agent, or Firm*—W. Scott Carson

[57] ABSTRACT

A vibrating float for prefinishing concrete. The float includes a float member with a planar surface, an elongated handle for manipulating the float member over the concrete with its planar surface in contact with the surface of the concrete, and a pair of pneumatically driven vibrators. The vibrators are mounted on the upper surface of the float member on either side of the centrally attached handle and can be adjusted easily and quickly to vary the vibrational pattern of the float member for the most efficient and effective working of the particular concrete mix. Each vibrator has an exterior housing member with a rotatable mounted collar member within it. The collar member is cylindrical and end pieces are provided to confine a ball member within the collar member. The housing member has an air hole through it and the collar member has at least two air holes in it of different sizes. By rotating the collar member relative to the housing member, the two holes in the collar member can be selectively placed in fluid communication with the air hole of the housing member. In this manner, the volume of air passing into the interior of the collar member can be varied to propel the ball member about the central axis of the collar member at different rates to thereby create differing vibrational patterns in the float member.

10 Claims, 7 Drawing Figures

CONCRETE PREFINISHING TOOL

FIELD OF THE INVENTION

This invention relates to the field of concrete finishing tools and more particularly to the field of vibrating floats for prefinishing concrete.

BACKGROUND OF THE INVENTION AND PRIOR ART

Most concrete finishing procedures are really multistep ones involving the use of several different tools and techniques to first work or consolidate the concrete and then smooth its surface. The main purposes of the working step are to remove air voids and excess water and to bring a thin layer of cement and fine aggregate to the surface which can then be finished by hand or machine as desired. Ideally, the working step will accomplish its purposes without unduly submerging the coarser aggregate and thereby destroying the general uniformity of the concrete mix.

In a common technique, concrete is worked with devices generally referred to as jitterbugs or roller packers after which a float is passed over it to give the concrete a relatively smooth surface which can be left as is or further finished. In most current techniques, the two steps of jitterbugging and floating are done separately using different tools; however, several patented floats have been equipped with vibrators in an attempt to perform these two steps with a single tool. Examples of such patented devices are U.S. Pat. Nos. 3,515,042, 3,515,043 and 3,547,014 to Austin, 2,282,248 to Davis, 2,514,626 to Clipson, and 3,376,798 to Bodine, and French Pat. No. 726,300 to Rand.

Of these patented devices, the three tools of Austin all have the distinct disadvantage that the drive for the vibrators is mounted on the float itself adding undesirable weight to it and making it impractical for use with higher slump (i.e., water) concrete mixes. Mounting the vibrator drive on the handle for the float as in U.S. Pat. No. 2,289,248 to Davis relieves some of the weight problems of Austin; however, it is believed to be preferable to have a remote power source as in the case of Clipson, Bodine, and Rand wherein the vibrators on the float are pneumatically or electrically driven and the weight of the power source is not carried by the tool at all. As between the vibrators of Davis and Bodine and those of Clipson and Rand, the rotating ones of Davis and Bodine versus the piston-type ones of the other two patents are believed to be preferable as far as their ability to bring a thin layer of cement and fine aggregate to the surface and remove air voids and excess water from the concrete mix. However, even these tools as well as all the other prior ones have limited ranges of frequency and amplitude and cannot be easily adapted for different slump (i.e., wetness) conditions of the concrete mix.

For the most part, any changes in frequency and/or amplitude in all of these prior art tools are limited to varying the output of the power source (e.g., increasing the motor speed or air pressure). For small variations in slump, such changes may well suffice. However, large variations in slump conditions (e.g., one-half inch to seven inches) require a widely varying range of frequencies and amplitudes for the proper working. Consequently, if a tool's frequency and amplitude cannot be readily changed over a wide range, the finisher must then keep several different tools on hand in order to be able to work the various slump conditions as the wrong frequency and/or amplitude can result in overworking the concrete and driving the coarse aggregate too far down in the slab thereby destroying its uniformity or underworking it and leaving undesirable air voids and water in the mix. Obviously, if a finisher has a tool with limited frequency and amplitude ranges and encounters an unexpected slump condition not within the tool's range, the concrete may well set up before the finisher can find a suitable tool or modify his present one accordingly. For example, the amplitude of Davis could be increased by replacing the eccentrically weighted bar with a larger one. However, this would only serve to create more undesirable weight on the float and an operator might well find that by the time he replaced the larger bar in the bearings of Davis and checked the dynamic balance, the concrete may well have already set up. Also, numerous jobs such as overlaying old concrete on bridge decks and laying patios, driveways, and sidewalks seeded with expensive surface rock often present unexpected concrete conditions requiring a relatively precise frequency and/or amplitude to properly work the concrete and set the surface rock in it. In such situations, the frequency and/or amplitude characteristics of a tool may be inappropriate and if its limited range of adjustments falls out of the ones needed, the tool is essentially useless.

It was with the above observations in mind that the concrete finishing tool of the present invention was developed. With the tool of the present invention, the advantages of a remote power system as in Rand and Bodine are combined with an improved vibrator design to produce a vibrating float whose frequency and amplitude can be easily and quickly adjusted over a wide range to handle varying slump conditions on the order of one-half to seven inches.

SUMMARY OF THE INVENTION

This invention involves a vibrating float primarily intended for use in prefinishing concrete. The float includes a float member with a planar surface and an elongated handle adjustably connected to the float member wherein the float member can be manipulated over the concrete with its planar surface in contact with the surface of the concrete. Mounted on the upper surface of the float member are a pair of pneumatically driven vibrators. Each of the vibrators can be easily and quickly adjusted to give a wide variety of vibrational patterns whereby the most effective pattern (frequency and vibration) can be selected for the most efficient and effective working of the particular concrete mix.

Each vibrator includes a housing member mounted to the top surface of the float member on either side of the centrally attached handle. Concentrically positioned within the housing member is an open-ended, substantially cylindrical collar member. The housing member and collar member have matching cylindrical surfaces whose radii are substantially the same about a common axis wherein the collar member can be rotated about the common axis within the housing member. The housing member has an air inlet hole extending through it from its outer surface to its inner, cylindrical surface. The collar member has at least two air holes through it extending from its outer to its inner surface. The holes in the collar member are radially spaced from each other about the common axis and are of different size. By rotating the collar member about the common axis between first and second positions relative to the housing member, each of the holes in the collar member can be selectively placed in fluid communication with the hole through the housing member. The inner surface of the collar member acts as a race for a ball member which is confined within the collar member by end pieces secured to the housing member and extending across the open ends of the collar member. One of the end pieces has channels therein which place the interior of the collar member in fluid communication with ambient air.

In operation, air under pressure is supplied to the air hole in the housing member through a flexible hose from a remote source. The collar member can then be rotated between its first and second positions to vary the rate of air volume passing into the vibrator and out the channels in the end piece covering one of the open ends of the collar member. In this manner, the vibrational pattern of the vibrator can be varied. Additionally, one end piece covering an open end of the collar member is easily removed so that different ball members can be run in the collar member enabling the vibrator to create even more vibrational patterns. In the preferred embodiment, the removable end piece is also part of the mounting means by which the vibrator is mounted on the top surface of the float member. In this embodiment, the removable end piece also serves to maintain the collar member in either of its first and second positions while the vibrator is in operation.

DETAILED DESCRIPTION OF THE PREFERRED EMBODIMENTS

Figure 1:
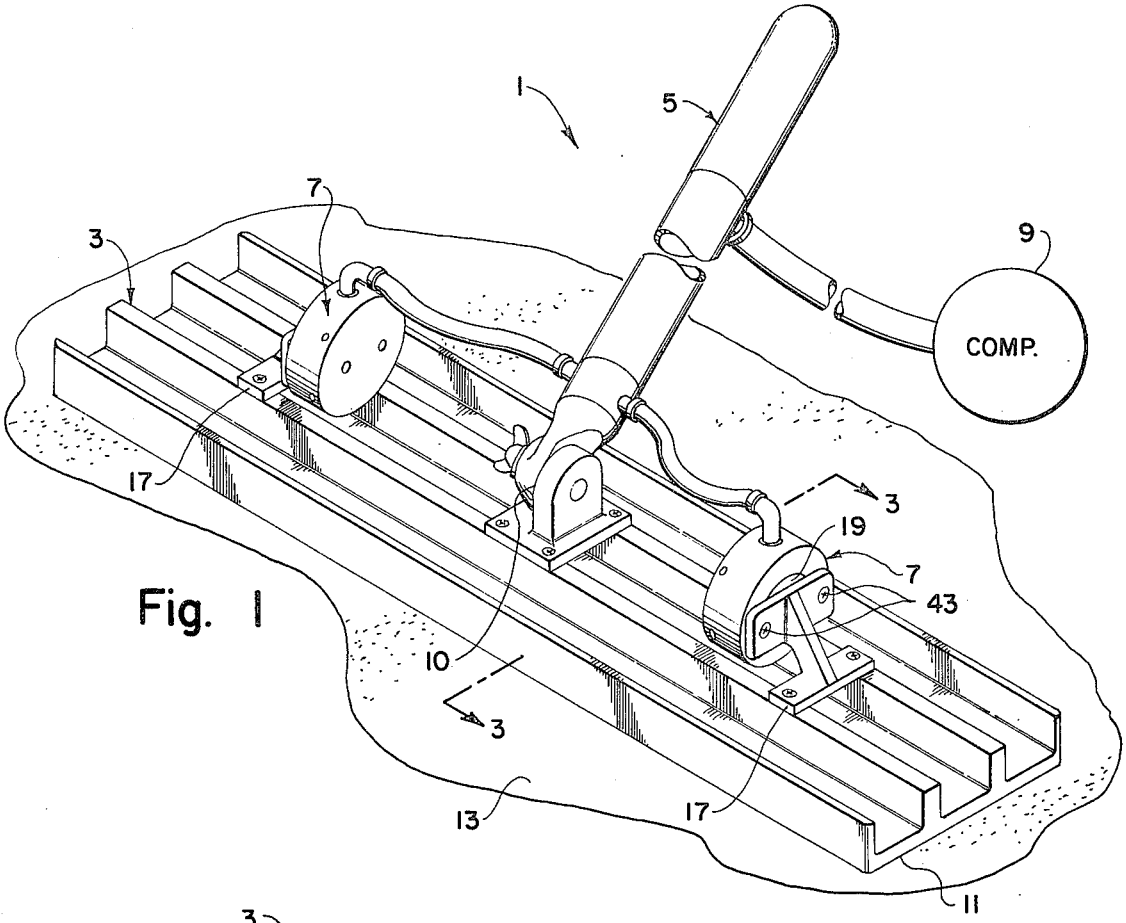
FIG. 1 is a perspective view of the vibrating float of the present invention illustrating its float member, handle, air supply, and pneumatically driven vibrators.
Figure 2:
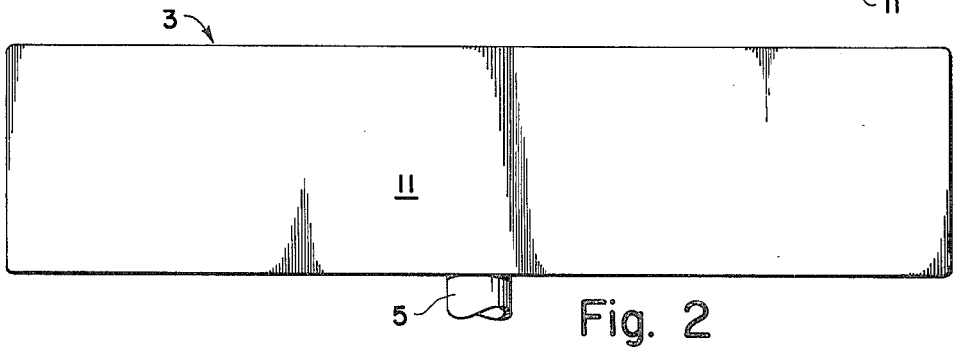
FIG. 2 is a bottom view of the float member showing its planar working surface.
Figure 3:
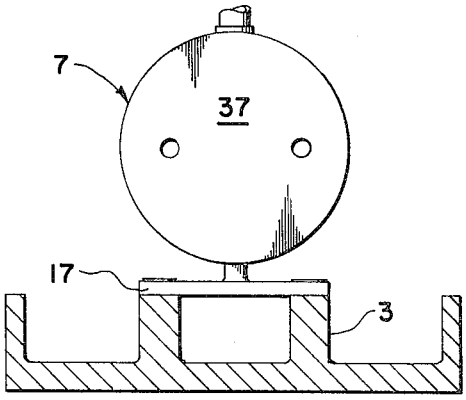
FIG. 3 is a side view taken along line 3—3 of FIG. 1 illustrating the relationship of the vibrator and float member.
Figure 4:
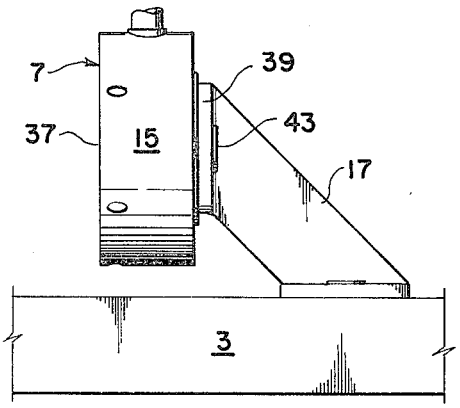
FIG. 4 is a portion of a front view of the vibrator, mounting means, and float member.

As best seen in FIG. 1, the vibrating float 1 of the present invention includes float member 3, elongated handle 5, and a pair of pneumatically driven vibrators 7 which are powered by air under pressure from the air supply 9. The handle 5 is adjustably connected at 10 to the float member 3 and is used to manipulate the float member 3 with its planar surface 11 in contact with the surface of the concrete 13.

Figure 5:
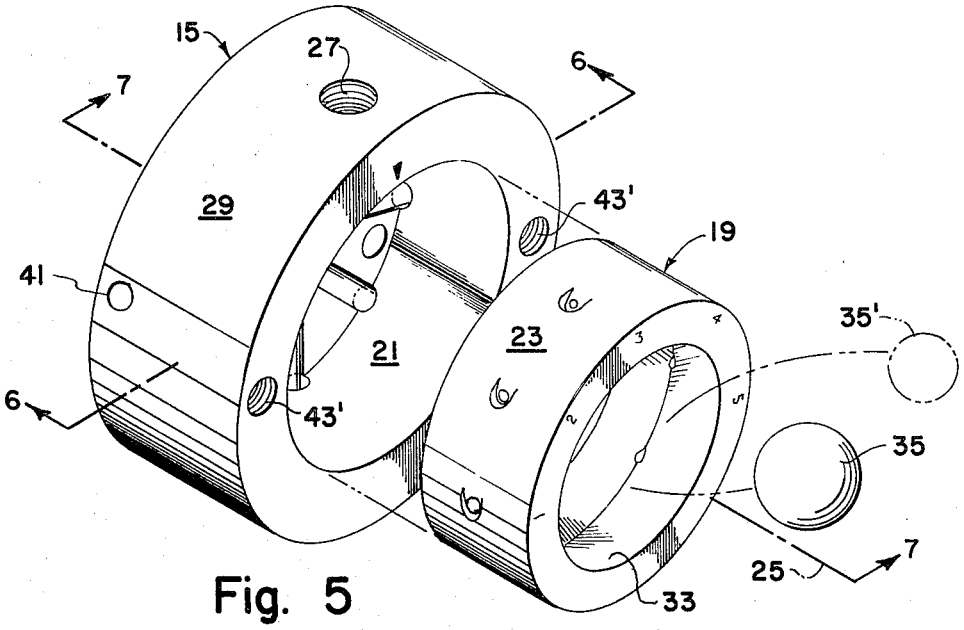
FIG. 5 is an exploded view of the vibrator.
Figure 6:
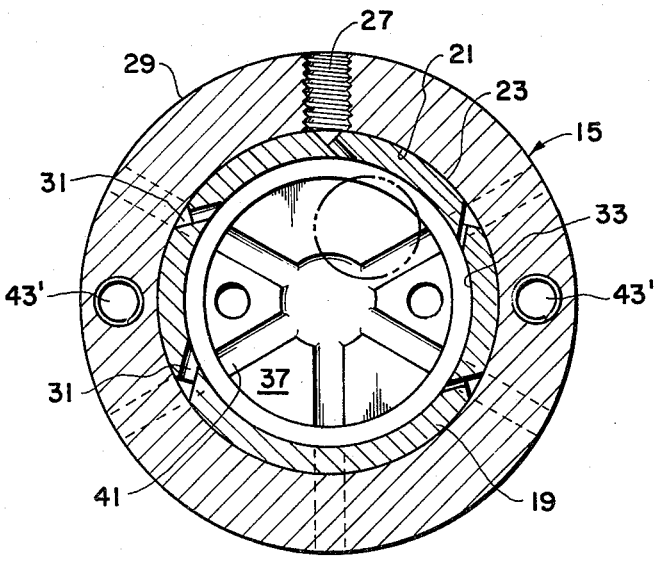
FIG. 6 is a view of the vibrator taken along line 6—6 of FIG. 5.
Figure 7:
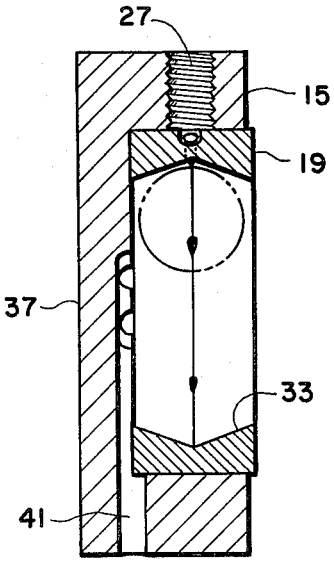
FIG. 7 is a view of the vibrator taken along line 7—7 of FIG. 5.

Each of the vibrators 7 includes a housing member 15 mounted to the top surface of the float member 3 by a mounting brace 17. Concentrically positioned within the housing member 15 is an open-ended, substantially cylindrical collar member 19 (see FIGS. 5–7). The housing member 15 and collar member 19 having matching cylindrical surfaces 21 and 23 whose radii are substantially the same about the common axis 25 wherein the collar member 19 can be rotated about the common axis 25 within the housing member 15.

The housing member 15 has an air inlet hole 27 extending through it from its outer surface 29 to its inner, cylindrical surface 21. The collar member 19 has at least two air holes 31 and preferably five through it from its outer to its inner surfaces 23 and 33. The holes 31 in the collar member 19 are radially spaced from each other about the common axis 25 and are of different sizes. By rotating the collar member 19 about the common axis 25 between first and second positions up to five positions relative to the housing member 15, each of the holes 31 in the collar member 19 can be selectively placed in fluid communication with the hole 27 through the housing member 15. The inner surface 33 of the collar member 19 acts as a race for a ball member 35 which is confined within the collar member 19 by end pieces 37 and 39 secured to the housing member 15 and extending across the open ends of the collar member 19. One of the end pieces 37 has channels or conduits 41 therein which place the interior of the collar member in fluid communication with ambient air. The channels 41 preferably extend radially outwardly of the common axis 25 to create minimum turbulence.

In operation, air under pressure is supplied to the air hole 27 in the housing member 15 through a flexible hose 43 from the remote source 9. The collar member 19 can then be rotated at least between its first and second positions and up to five in the preferred embodiment to vary the rate of air volume passing into the vibrator 7 and out the channels 41 in the end piece 37 covering one of the open ends of the collar member 19. In this manner, the vibrational pattern (frequency and amplitude) of the vibrator 7 can be varied. Additionally, the end piece 39 covering the other open end of the collar member 19 is easily removed so that different ball members 35 and 35' can be run in the collar member 19 enabling the vibrator 7 to create even more vibrational patterns.

In the preferred embodiment, the removable end piece 39 is also part of the mounting means 17 by which the vibrator 7 is mounted on the top surface of the float member 3. In this embodiment, the removable end piece 39 also serves to maintain the collar member 19 in any of its five positions while the vibrator 7 is in operation.

This is due to the fact that the end piece 37 is preferably an integral part of the housing member 15 and with the housing member 15, forms a cylinder with one open end into which the collar member 19 is received. The inner and outer surfaces 21 and 29 of the housing member 15 extend about a first axis and the inner and outer surfaces 23 and 33 extend about a second axis. When the collar member 19 is inserted into the housing member 15 the first and second axes are coincident forming the common axis 25. The cylinder with one open end formed by housing member 15 and end piece 37 (see FIG. 7) has a depth which is less than that of the collar member 19 wherein one end of the collar member 19 protrudes outwardly of the housing member 15 when the other end of the collar member 19 abuts end piece 37. Consequently, with the screws 43 in FIG. 1 removed, the collar member 19 can be rotated as desired and the ball member 35 replaced. With the screws 43 merely lossened within screw holes 43' in the housing member 15, the collar member 19 can also be rotated to the position desired and then held in place by a friction grip between that end of the collar member 19 and end piece 39 once the screws 43 are retightened.

While several embodiments have been shown and discussed, it is to be understood that modifications can be made to these embodiments without departing from the scope of this invention.

We claim:

1. A vibrating float primarily intended for use in prefinishing concrete, said float comprising:

a float member having a substantially planar surface, handle means attached to said float member for manipulating said float member over the concrete with the planar surface thereof in contact with the surface of the concrete, and means for vibrating said float member, said vibrating means including at least one pneumatically driven vibrator and means for mounting said vibrator to said float member, said vibrator having (i) a housing member with inner and outer surfaces extending about a first axis, said inner surface being substantially cylindrical and extending about said first axis at a first radius, said housing member having at least one hole extending therethrough from the outer to the inner surfaces thereof, (ii) an open-ended, substantially cylindrical collar member with inner and outer surfaces extending about a second axis, said outer surface being substantially cylindrical and having a radius substantially equal to the radius of the inner cylindrical surface of said housing member and being concentrically receivable therein with said first and second axes coincident to form a common axis, said collar member having at least two holes of different sizes extending therethrough from the outer to the inner surfaces thereof, said holes being spaced from each other radially about said common axis and entering said inner surface along axes inclined to the radius of said inner surface, said collar member being rotatable about said common axis relative to said housing member at least between a first radial position with the hole in the housing member and one of the holes in said collar member in fluid communication with each other and a second radial position with the hole in the housing member and the other of the holes in said collar member in fluid communication with each other, (iii) a ball member receivable within said collar member against the inner surface thereof, (iv) means for substantially closing the open ends of said collar member to confine said ball member therein, (v) means for supplying air under a first pressure to said hole in said housing member, (vi) conduit means for placing the holes in said collar member in fluid communication with ambient air wherein air under the first pressure of said air supply flows through the interior of said collar member when said collar member is in either of said first and second positions to propel the ball member about said common axis against the inner surface of said collar member and produce vibrations in said float member, and (vii) means for selectively maintaining said collar member in said first and second positions wherein the differing air flow rates of the first and second positions due to the differently sized holes through the collar member produce at least two different vibrational patterns which can be selected as desired to vibrate said float member as said float member is manipulated using said attached handle means over the concrete with the planar surface of said float member in contact with the surface of the concrete.

2. The float of claim 1 wherein said means for substantially closing the open ends of said collar member includes a first member and means for releasably securing said first member across one of said open ends wherein said first member can be easily and quickly removed and the ball member replaced with a different sized ball member to further vary the vibrational patterns produced by the vibrator.

3. The float of claim 2 wherein said means for substantially closing the open ends of said collar member includes a second member and means for securing said second member to said housing member across the other of said open ends, said housing member and said second member secured thereto forming a cylinder with one open end and having a depth in a direction parallel to said common axis less than the depth of said collar member wherein the other of said open ends of said collar member protrudes outwardly of said housing member when the one end of said collar member is in an abutting relationship with said fist member, and said means for releasably securing said first member includes means for drawing said first member into an abutting relationship with the other of said open ends of said collar member to thereby selectively maintain said collar member in said first and second positions.

4. The float of claim 1 wherein said means for substantially closing the open ends of said collar member includes a member and means for securing said member across one of said open ends, said member having air exhaust channels therein extending radially outwardly of said common axis.

5. The float of claim 2 wherein said first member and said mounting means have a common planar surface abutting the other of the open ends of said collar member.

6. A pneumatically driven vibrator having (i) a housing member with inner and outer surfaces extending about a first axis, said inner surface being substantially cylindrical and extending about said first axis at a first radius, said housing member having at least one hole extending therethrough from the outer to the inner surfaces thereof, (ii) an open-ended, substantially cylindrical collar member with inner and outer surfaces extending about a second axis, said outer surface being substantially cylindrical and having a radius substantially equal to the radius of the inner cylindrical surface of said housing member and being concentrically receivable therein with said first and second axes coincident to form a common axis, said collar member having at least two holes of different sizes extending therethrough from the outer to the inner surfaces thereof, said holes being spaced from each other radially about said common axis and entering said inner surface along axes inclined to the radius of said inner surface, said collar member being rotatable about said common axis relative to said housing member at least between a first radial position with the hole in the housing member and one of the holes in said collar member in fluid communication with each other and a second radial position with the hole in the housing member and the other of the holes in said collar member in fluid communication with each other, (iii) a ball member receivable within said collar member against the inner surface thereof, (iv) means for substantially closing the open ends of said collar member to confine said ball member therein, (v) means for supplying air under a first pressure to said hole in said housing member, (vi) conduit means for placing the holes in said collar member in fluid communication with ambient air wherein air under the first pressure of said air supply flows through the interior of said collar member when said collar member is in either of said first and second positions to propel the ball member about said common axis against the inner surface of said collar member and produce vibrations, and (vii) means for selectively maintaining said collar member in said first and second positions wherein the differing air flow rates of the first and second positions due to the differently sized holes through the collar member produce at least two different vibrational patterns which can be selected as desired.

7. The vibrator of claim 6 wherein said means for substantially closing the open ends of said collar member includes a first member and means for releasably securing said first member across one of said open ends wherein said first member can be easily and quickly removed and the ball member replaced with a different sized ball member to further vary the vibrational patterns produced by the vibrator.

8. The vibrator of claim 7 wherein said means for substantially closing the open ends of said collar member includes a second member and means for securing said second member to said housing member across the other of said open ends, said housing member and said second member secured thereto forming a cylinder with one open end and having a depth in a direction parallel to said common axis less than the depth of said collar member wherein the other of said open ends of said collar member protrudes outwardly of said housing member when the one end of said collar member is in an abutting relationship with said first member, and said means for releasably securing said first member includes means for drawing said first member into an abutting relationship with the other of said open ends of said collar member to thereby selectively maintain said collar member in said first and second positions.

9. The vibrator of claim 7 wherein said first member and said mounting means have a common planar surface abutting the other of the open ends of said collar member.

10. The vibrator of claim 6 wherein said means for substantially closing the open ends of said collar member includes a member and means for securing said member across one of said open ends, said member having air exhaust channels therein extending radially outwardly of said common axis.

* * * * *